US005646378A

United States Patent [19]

Van Haaff et al.

[11] Patent Number: 5,646,378

[45] Date of Patent: Jul. 8, 1997

[54] COLLAPSIBLE MODULAR SOUND REPRODUCTION SYSTEM

[76] Inventors: Vincent Van Haaff, 8927 Hollyplace, Los Angeles, Calif. 90046; Ivan Kadey, 1827 - 9th St., Santa Monica, Calif. 90404

[21] Appl. No.: 513,354

[22] Filed: Aug. 10, 1995

[51] Int. Cl.[6] ..... E04B 1/99

[52] U.S. Cl. ..... 181/30; 181/144

[58] Field of Search ..... 181/30, 144, 148, 181/155, 154, 175, 176, 199; 381/88, 90, 160, 205

[56] References Cited

U.S. PATENT DOCUMENTS

| | | | |
|---|---|---|---|
| 3,217,366 | 11/1965 | Wenger . | |
| 4,104,835 | 8/1978 | Bardwick, III . | |
| 4,190,739 | 2/1980 | Torffield | 181/30 X |
| 4,227,047 | 10/1980 | Horne . | |
| 4,286,688 | 9/1981 | O'Malley | 181/199 X |
| 4,296,280 | 10/1981 | Richie . | |
| 4,421,200 | 12/1983 | Ferralli et al. | 181/144 |
| 4,843,624 | 6/1989 | Rashak | 381/88 X |
| 4,940,108 | 7/1990 | Selby . | |
| 5,168,129 | 12/1992 | D'Antonio | 181/30 |
| 5,205,101 | 4/1993 | Swan et al. . | |
| 5,216,209 | 6/1993 | Holdaway | 181/144 |

*Primary Examiner*—Khanh Dang

*Attorney, Agent, or Firm*—Blakely Sokoloff Taylor & Zafman

[57] ABSTRACT

A high fidelity audio playback wall. A transportable frame is used to rigidly fix loudspeakers and acoustic panels to correlate sound in a stereophonic manner. The acoustic panels are arranged to channel sound into a diffuse distributed sound field. The geometric relation of the panel interconnection and the ratios of panel surfaces areas maintain high fidelity in the sound field.

13 Claims, 4 Drawing Sheets

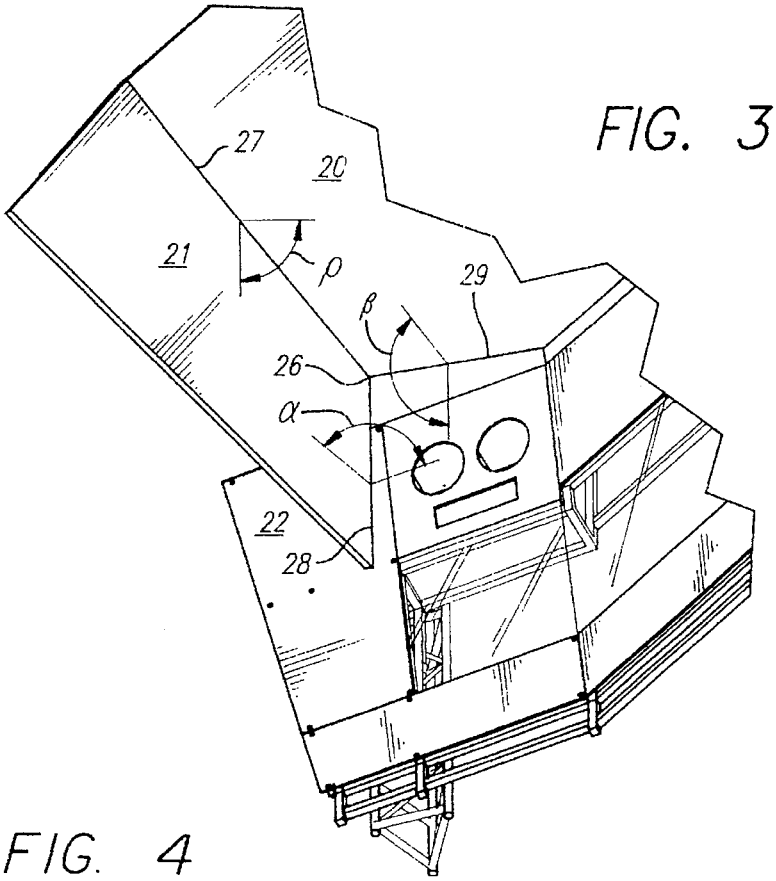
FIG. 3
FIG. 4
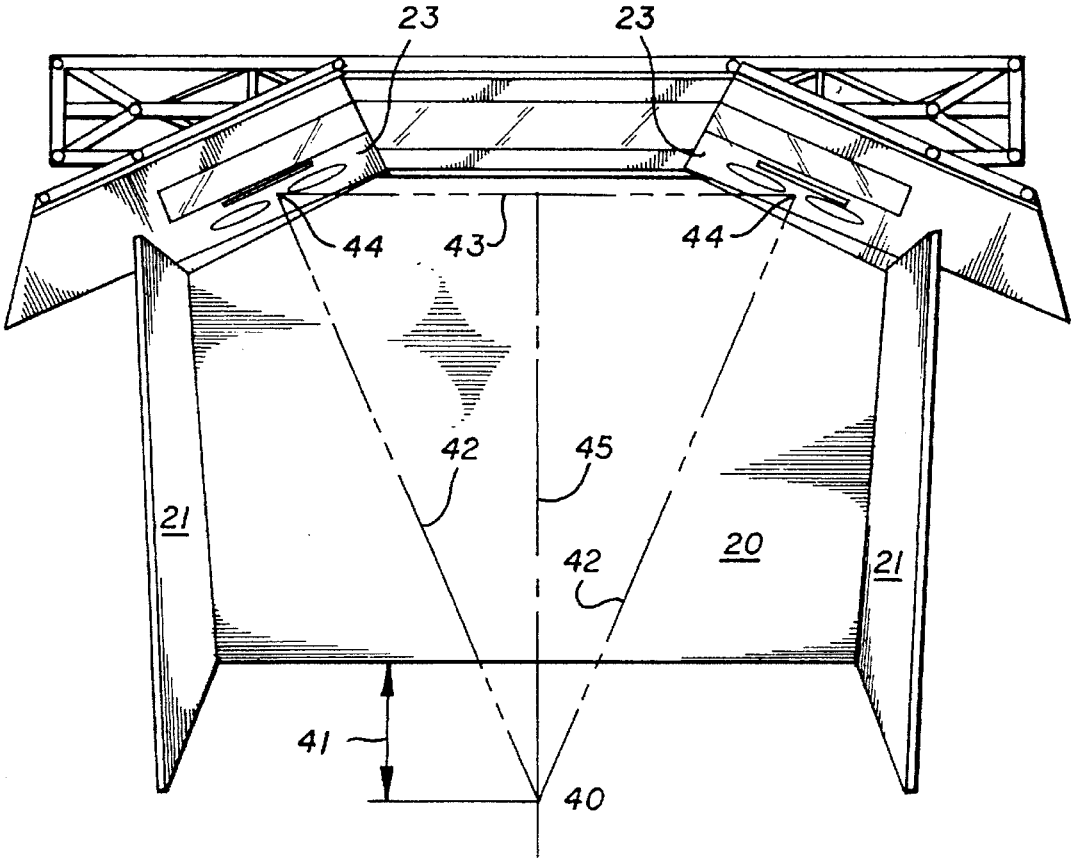

COLLAPSIBLE MODULAR SOUND REPRODUCTION SYSTEM

BACKGROUND OF THE INVENTION

1. Field of the Invention

The invention relates to a portable structure for producing high fidelity audio playback. More specifically, a transportable frame with geometrically shaped acoustic panels which rigidly fixes loudspeakers to correlate sound in a stereophonic manner with sufficient fidelity to be compatible with established professional production standards.

2. Related art

Loudspeakers are generally old and well-known in the art. Loudspeaker enclosures employing singular or multiple driver elements are designed to project a full audio frequency spectrum toward a listener in such a manner that the results of quadratic diffusion and dispersion of energy have the least effect on coloration through interfrequency harmonic distortion and frequency dependent directivity known as polarity patterns.

Other effects on the frequency response of a single or multiple loudspeakers are: (i) properties of room boundaries such as the rooms geometrical interrelationship and the absorptive and diffusive properties of these boundaries, (ii) the volume and configuration of the loudspeaker enclosure in relationship to the room volume, (iii) the placement of the loudspeakers in the room with respect to mounting and the distance to the boundaries and other loudspeakers when multiples of loudspeakers are used, and (iv) how the loudspeakers are interconnected.

To achieve the lowest possible interfering resonant frequency of the structural and mounting parts of a loudspeaker, or multiple loudspeakers acting upon a room air volume, the loudspeakers are often resiliently mounted or otherwise mounted rigidly to a structure and weighted down with some manageable devices such as sandbags or concrete slabs.

To allow the accurate distribution of stereophonic sound signals, the two loudspeakers are placed so that the surrounding boundaries are symmetrically responsive whereby an imaginary centerline is described through the center of the pair relative to the reaction of the surrounding air volume. Depending on the accuracy of the symmetry, this line can be linear or curved. The more linear this line, the more symmetrical the dispersion. The more symmetrical the dispersion within the air volume, the higher the fidelity accomplished.

To accomplish the most symmetrical dispersion, fixed professional production facilities employed special rooms having speakers fixedly mounted therein, sloped ceilings and highly absorptive walls. While some mobile remote studios exist, they tend to be in vans. Accordingly, they are significantly limited as to size. Such size limitations negatively affect the ability to reproduce the sound of the desired fidelity. Moreover, many venues exist wherein a van based playback facility is inadequate or unusable. It is therefore desirable to develop a portable system which allows high fidelity playback comparable to a professional studio control room.

BRIEF SUMMARY OF THE INVENTION

A portable sound wall for producing high fidelity playback outside a sound studio is disclosed. A modular support structure is constructed to rigidly maintain loudspeakers in relation to each other such that a diffuse distributed sound field is created. Geometrically arranged acoustic panels are used to channel the sound into the desired sound field. The geometry of the panel interconnection offsets the inherent quadratic diffusion of low frequency sound, while high frequency diffusive flaps distribute the high frequency sound to achieve a balance of power within the predetermined sound field.

BRIEF DESCRIPTION OF THE DRAWINGS

FIG. 3 is a perspective view of fight side of the embodiment of FIG. 1 showing angles of plane intersection.

FIG. 4 is a bottom plan view of the embodiment of FIG. 1.

DETAILED DESCRIPTION OF THE INVENTION

The present invention is portable sound wall for the playback of high fidelity audio signals. In the following Detailed Description, numerous specific details are set forth in order to provide a thorough understanding of the present invention. However, it will be apparent to one of ordinary skill in the art that these specific details need not be used to practice the present invention. In other circumstances, well known structures and materials have not been shown or described in detail in order to not unnecessarily obscure the present invention.

Figure 1:
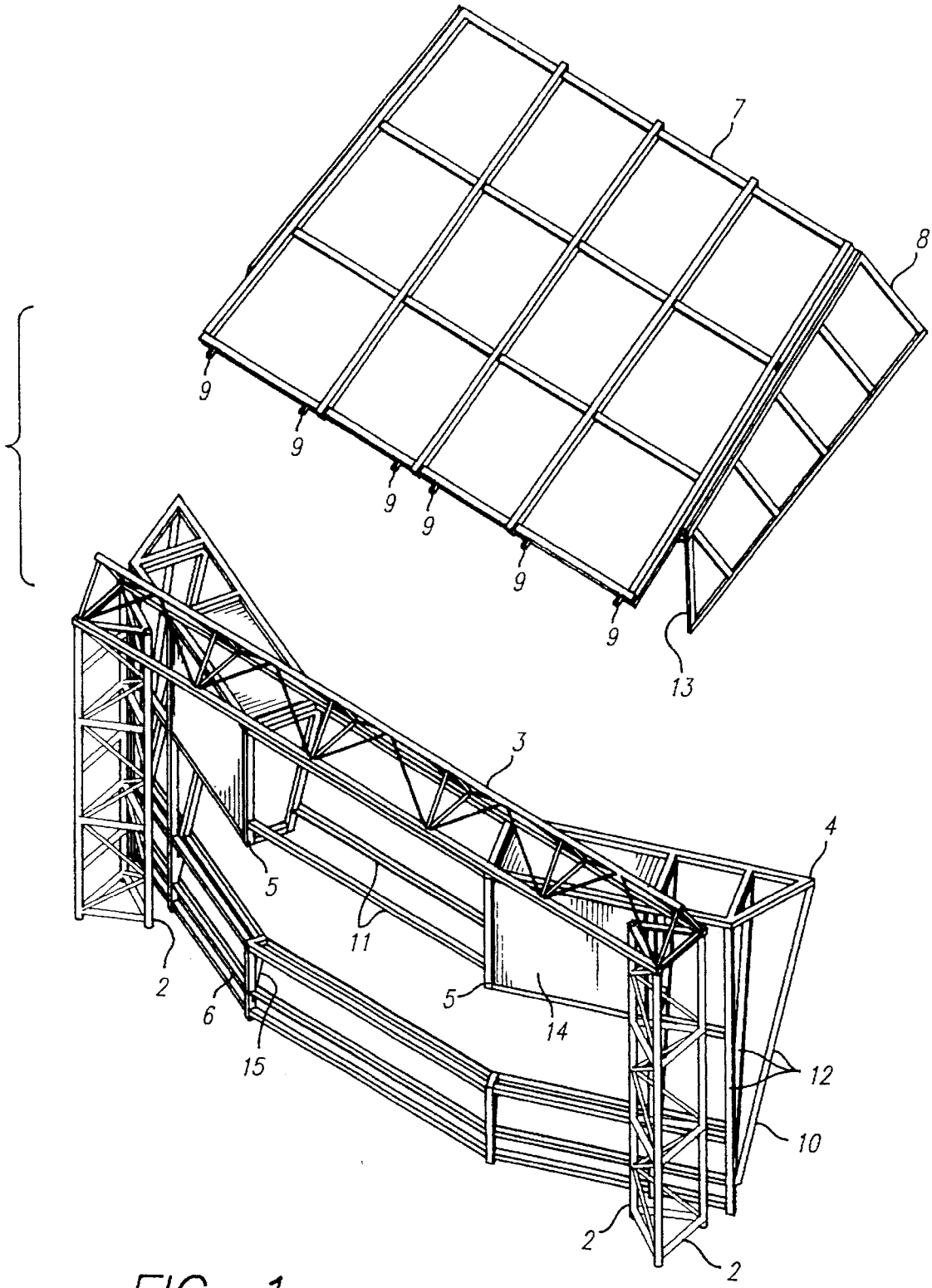
FIG. 1 is an exploded back perspective view of one embodiment of the instant invention.
Figure 5:
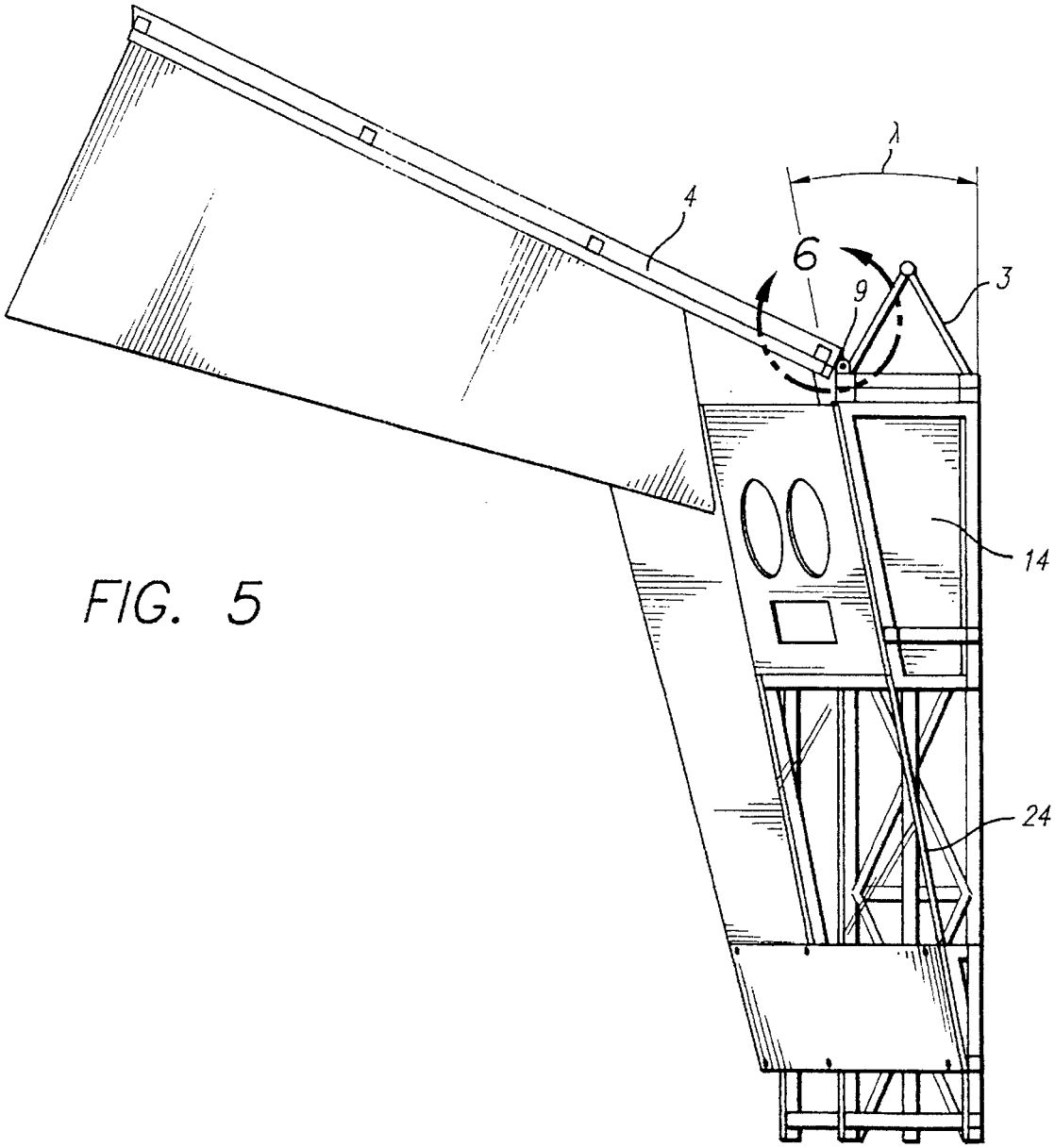
FIG. 5 is a sectional view of the embodiment of FIG. 1.

Now referring to FIG. 1 which is an exploded back perspective view of the support structure audio playback wall of the instant invention. In one embodiment of the instant invention, the truss structure 1 having towers 2 and cross support 3 is coupled to a frame 10. The towers and cross support can be constructed of triangular truss members suitable for bearing heavy loads. The frame 10 is modular having a top frame 4, speaker basket 5 disposed thereunder and held in fixed relation to each other by cross beams 11. Vertical support members 12 provide additional vertical support for the top frame 4 and speaker baskets 5 and they are coupled to the pedestal 6 and lower frame 15. The height of the speaker baskets can be adjusted by adjusting the height of the pedestal while maintaining the other aspects of the frame in a fixed geometric relation to each other. Ceiling frame 7 is coupled to flap frame 8 using hinges or any alternative rotatable coupling device 9 to form a unit which rotatably couples to cross support 3, thereby forming a cantilever such that an edge of a flap (not shown) coupled to frame 8 engages the side panels (not shown) of the wall to support the cantilevered ceiling. FIG. 5 is a cutaway showing the rotatable coupling of ceiling frame 7 to cross support 3. Significantly, this rotatable coupling allows the ceiling frame to rotate in a 90° arc from parallel to the floor to perpendicular to the floor. This coupling device allows the ceiling assembly to act on the front 24 and side panels, with the flaps functioning as a corbel brace to support the top panel and ceiling frame.

Rigidity of the completed wall is highly desirable. Accordingly, the frame can be composed of any suitably rigid material. It is desirable to have an easily workable medium which allows set up and tear down within an acceptably short time frame. It has been found that a two-inch square aluminum tubing is suitable for this purpose. A number of structural materials of adequate rigidity exists. Among the suitable frame materials are aluminum alloys and carbon-fibre composites. Angle pieces are used to form the speaker baskets 5, thereby reducing possible movement of the speaker enclosure 14 within the speaker basket 5. It is essential that symmetry be maintained from right to left about a center axis of the wall. Accordingly, any structure described as existing on the right half of the wall will be mirrored exactly on the left half of the wall.

Figure 2:
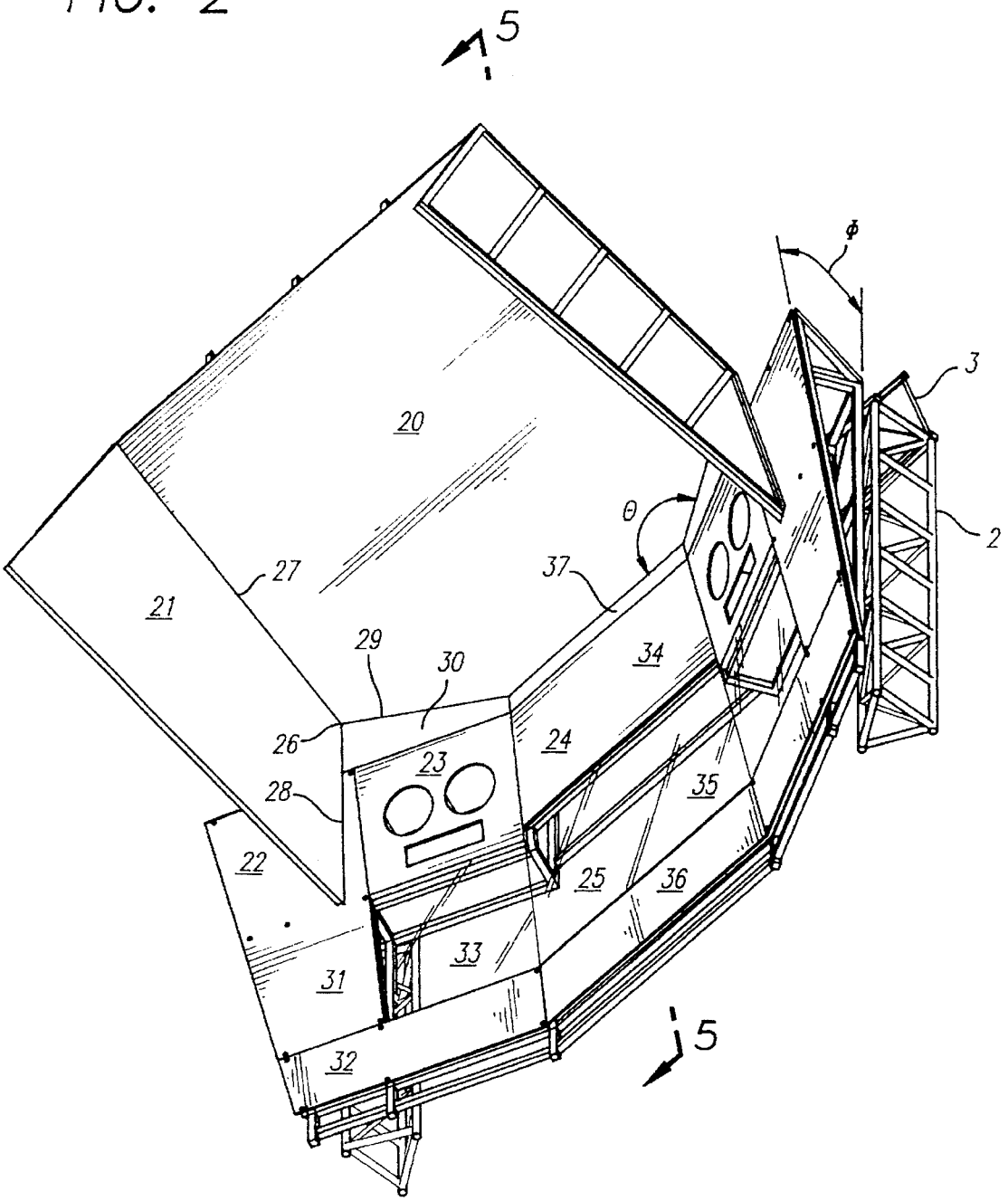
FIG. 2 is a perspective view of the embodiment of FIG. 1.

FIG. 2 shows a front perspective view of the sound wall of the instant invention. A front panel 24 is coupled to the frame 10 and composed of four coplanar panel segments 34–37. Disposed adjacent thereto are side panels 22 which are flush with speaker baffle 23 of the speaker enclosure 14. Side panel 22 is composed of four coplanar panel segments 30–33 also coupled to frame 10. While it would be possible to construct from panel 24 and side panel 22 each from a unitary piece of material, from a manufacturing and handling perspective, the described modular approach is more desirable.

In one exemplary embodiment, top panel 20 is trapezoidal having a base of 11'4 14/16", and a base of 12'8 9/16", and a height of 9'4¼". The front panel has bases of 5'5⅛" and 6'10", and a height of 8'6⅛". The side panel segments 31–33 and the speaker baffle 23 form a right trapezoidal surface with bases 5'8 15/16" and 6'11 14/16", and a height of 8'1 5/16". Side panel segment 33 is a quadrangle having angles of 85°, 83°, 90°, and sides of length 3'11¾", 4⅞" defining the right angle. The flaps 21 should each be constructed from a single piece of material to increase rigidity of the flap 21 and thereby improve the fidelity of the sound reproduced. In one embodiment, the flaps are quadrangles having angles of 90°, 124¼° and 62° and sides of 4' and 7'4 7/16" defining the right angle and a side 3'7½" between the 124½" angle and the 62° angle which acts against side panel 22 along line of intersection 28.

In the above-described embodiment, panel segments can be constructed from wafer board which is commercially available in 4'×10' sheets. In such embodiment, since front and side panels exceed these dimensions of a single sheet, modularity is required. Each side panel 22 and front panel form an angle Θ with each other. Them should typically be in the range of 150°–160°. In one embodiment, an angle of 156½° is employed. Moreover, the speaker baffle 23 and accordingly the side panel 22 are tilted at an angle Φ with the vertical. A speaker tilt angle Φ of 12° is employed in an exemplary embodiment. PH1 should typically be in the range of 0°–15°. The front panel 24 also has a tilt angle. Such tilt angle is dictated by Φ and Θ. This results in a reverse keystone appearance and, accordingly, a trapezoidal front panel 24. The critical dimension of the front panel is the distance between the lower inside corners of the speaker enclosures. In one embodiment, this dimension is 6'±1". In an alternate embodiment, this dimension is 3'±1". In either embodiment, the geometrical relation between the various panels must be maintained. It is envisioned that the dimension between lower inside corners can be in the range of 1'8"–12' provided the geometrical and surface area relations are maintained. Moreover, it is desirable to maintain the ratio of surface areas between the front panel 24, side panels 22, top panel 20, and flaps 21. It has been found that increasing the area of the top panel 20 and flaps 21 without a corresponding increase in the other panel areas reduces the stability of the structure. Decreasing the area of the top panel and flaps relative to the structure negatively effects the fidelity of the sound created.

Now referring to FIG. 3, top panel 20 is coupled to ceiling frame 7. Flaps 21 are coupled to flap frame 8. FIG. 3 shows flap frame 8 and ceiling frame 7 retain the top panel 20 and flap 21 in fixed relation to one another such that top panel 20 and flap 21 meet to form an angle ρ along a line of intersection 27. Flap 21 acts on side panel 22 and forms an angle α along a line of intersection 28 therewith. Top panel 20 meets side panel 22 to form an angle β along third line of intersection 29. Lines of intersection 27, 28, and 29 intersect at intersection point 26. Angles α, β and ρ should all be obtuse angles. In one embodiment, top panel 20 defines an angle of 25° with the horizontal and side flaps defining an angle of 9½° with the vertical. The angle defined between the top panel and the horizontal should be in the range 19°–28°. As the angle with the horizontal decreases, the flap to vertical angle increases in the range 9½°–15°. Accordingly, ρ always exceeds 90°, and the sum of the three angles is in the range of 325°–335°. In one embodiment, α is 124½°, β is 114¾°, and ρ is 98½°.

The intersection point 26 acts as a low frequency source during playback because interference patterns created by the orientation of the various panels result in low frequency addition emanating from point 26. Directing this low frequency source toward the speaker focal point compensates for problems of quadratic diffusion of low frequency sound wave. This assists in balancing high and low frequency power in the sound field about the focal point. Moreover, compensating for any malfunction in the sound reproduction can be achieved by adjustment at intersection points 26. Because with conventional methods of sound reproduction, low frequency sound waves tend to suffer quadratic diffusion much more rapidly than high frequency sound waves, it is essential that flaps 21 be constructed of a high frequency diffusive material. Moreover, it is desirable that all of the surfaces be low frequency reflective.

The weight of the top panel and flap combination bearing against the upper edge of the side panels also loads the speaker enclosures, thereby reducing resonance in the speaker enclosures and the overall structures. The loading creates a resultant force vector directed through the lower center of the pedestal 6. Accordingly, all interior resonances are damped along the longest structural path with the greatest structural mass possible.

Now referring to FIG. 4 which is a bottom plan view of the instant invention showing the focal point 40 of the speaker assembly, the focal point 40 is defined by the point of intersection of the legs 42 of an isosceles triangle having a base 43 drawn between the center of 44, the fight and left speaker baffles 23 drawn perpendicular to the center of the speaker baffle 23. The intersection/focal point 40 occurs along the axis of symmetry 45 of the sound wall at a predetermined distance 41 beyond the overhang of the top panel 20. In the preferred embodiment, the predetermined distance 41 beyond the overhang is approximately 30 inches.

By diffusing a high frequency at the flap 21 while reflecting low frequency throughout, the power of the high frequency and low frequency can be equalized at the focal point. The width of the sound field in which the high fidelity sound of the focal point exists can be expanded by increasing the area of the flaps or increasing the distance between the right and left flap. Providing panels of high stiffness or rigidity is also highly desirable. The panels should be constructed of a non-resonant material. A number of materials are adequately high frequency, diffusive among these are sheet rock with a skim coat and wafer board. Other similar lightweight, rigid materials, such as plywood or particle board, are also suitable.

The pedestal 6 can be used to adjust the height of the sound field and focal point. Pedestal 6 need not be covered by paneling and in an exemplary embodiment 13 is perpendicular to the ground. As would be apparent to one of ordinary skill in the art, if the dimension of the panels is reduced (as in the embodiment with 3' between the speaker enclosures), the resulting sound field and speaker focal point will be closer to the ground. By adjusting the height of the pedestal 6, the location of the sound field can be "tuned" to keep it consistent between embodiments. It is also possible to provide a viewing window 25 by using Plexiglas or other rigid, lightweight, transparent material for panel segment 35 or panel segments 33 and 35. This arrangement is desirable when the listener in front of the wall wants or needs to view what is occurring behind the wall, for example, when a sound engineer wishes to compare recorded product to a live and ongoing performance. Alternatively, the front and side panels can be composed completely of a laminate as described below, or another suitable material.

In terms of workability, wafer board is particularly desirable because it is easily drilled and attached to the frame. By using two layers of wafer board sandwiching, for example polystyrene or cardboard honeycomb panels of adequate stiffness with a desirable high frequency diffusion can be created. The center material should be chosen to have different density than the facing layers. The above-described sandwiched laminate is highly non-resonant owing to the Doppler effect created by the different media composing the laminate. It is possible to use a laminate of sheet rock, polystyrene, and wafer board, where the wafer board is the backing which provides for easy attachment to the frame. It is also possible to use a single layer of material, however, laminates have been found to yield superior stiffness and non-resonant characteristics.

FIG. 5 is a section view taken about the axis of symmetry. Hinge 9 can be seen rotatably coupling a top frame 4 to cross support 3. Speaker enclosure 14 is retained within speaker basket 5. Front panel 24 can be seen forming an angle Λ with the vertical. Other significant features are described with reference to prior figures.

Figure 6:
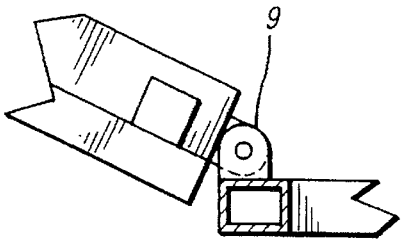
FIG. 6 is a cutaway view of the rotational coupling feature of the embodiment of FIG. 4.

FIG. 6 is a cutaway of the rotatable coupling member 9 which can be used to attach the ceiling frame and top panels to the supports structure such that the flaps 21 can act as a corbel brace against the side panels 22. The coupling member 9 can be a hinge, a hook and rod arrangement, or any conventional coupling device which allows the coupled marker to rotate relative to one another.

In the foregoing specification, the invention has been described with reference to specific embodiments thereof. It will however be evident that various modifications and changes made thereto without departing from the broader spirit and scope of the invention as set forth in the appended claims. The specification and drawings are accordingly, to be regarded in an illustrative rather than a restrictive sense. Therefore, the scope of the invention should be limited only by the appended claims.

We claim:

1. An apparatus comprising:

a support structure a front panel coupled to the support structure a right and a left side panel disposed adjacent to and symmetrically about the front panel and each defining a first predetermined angle therewith, the side panels tilted forward to each form a second predetermined angle with a vertical plane:

at least one speaker enclosure having a speaker baffle, the baffle being disposed in coplanar relation with at least one of the right and left side panels;

a top panel coupled to the support structure and having a right and left flap disposed on the top panel.

2. The apparatus of claim 1 wherein the top panel is rotatably coupled to the support structure, and the flaps form a corbel brace to support the top panel.

3. The apparatus of claim 2 wherein the top panel defines a first line of intersection with a respective flap and a second line of intersection with a respective side panel; the respective flap and side panel meeting to define a third line of intersection; the three lines of intersection intersecting at a common intersection point such that a first, a second, and a third obtuse angle are defined each with a vertex at the intersection point.

4. The apparatus of claim 3 wherein the first and second angles are in the range 105°–127°, and the third angle is in the range 90°–100°.

5. The apparatus of claim 3 wherein at least one panel segment of one of the front panel; the right side panel and the left side panel forms a viewing window.

6. The apparatus of claim 3 wherein the flaps have a high frequency diffusing surface.

7. The apparatus of claim 3 wherein the first predetermined angle is in the range of 150°–160°.

8. The apparatus of claim 3 wherein the second predetermined angle is the range of 0°–15°.

9. A method of making a high fidelity playback system portable comprising the steps of:

providing a modular support structure;

disposing a plurality of speaker enclosures in a plurality of speaker baskets, the speaker baskets coupled to the support structure in a fixed relation to each other;

coupling a front panel to the support structure;

attaching right and left side panels at a predetermined angle to the front panel and defining a second predetermined angle with a vertical plane, the side panels being coplanar with a front baffle of at least one speaker enclosure;

connecting an end of a top panel to the support structure; and disposing flaps on the top panel, the flaps acting as a corbel brace against the side panels to support the top panel at a third predetermined angle relative to a horizontal plane.

10. A portable sound wall capable of retaining a plurality of speaker enclosures comprising a portable support structure means for rigidly fixing a position of a first and a second speaker enclosure relative to each other when the first and second speaker enclosures are disposed in the support structure;

a front panel coupled to the portable support structure a pair of side panels coupled to the portable support structure symmetric about the front panel and defining a front surface of a speaker enclosure;

a predetermined angle with the front panel; and a top panel having a pair of symmetric flaps coupled thereto, the top panel being coupled to the portable support structure at one end, the flaps acting as a corbel brace between the top panel and the side panels.

11. The portable sound wall of claim 10 wherein the side panels are tilted forward to define an angle in the range of 0°–15° with a vertical plane.

12. The portable sound wall of claim 10 wherein the flaps comprise a high frequency diffusive surface.

13. The portable sound wall of claim 10 wherein the panels comprise a wafer board laminate.

* * * * *